US006116001A

United States Patent [19]

Kammler et al.

[11] Patent Number: 6,116,001

[45] Date of Patent: Sep. 12, 2000

[54] DEVICE FOR PACKAGING

[75] Inventors: Roman Kammler, Worms; Walter Baur, Gruendau, both of Germany

[73] Assignee: Rovema Verpackungsmaschinen GmbH, Fernwald, Germany

[21] Appl. No.: 09/185,781

[22] Filed: Nov. 4, 1998

[30] Foreign Application Priority Data

Nov. 5, 1997 [DE] Germany ..... 197 48 805

[51] Int. Cl.[7] ..... B65B 9/06

[52] U.S. Cl. ..... 53/551; 141/67

[58] Field of Search ..... 53/551, 552, 554, 53/555, 527; 141/67

[56] References Cited

U.S. PATENT DOCUMENTS 3,040,490 6/1962 Virta ..... 53/551 X 4,738,287 4/1988 Klinkel ..... 53/551 X

FOREIGN PATENT DOCUMENTS 0 192 604 7/1988 European Pat. Off. .

*Primary Examiner*—Linda Johnson

*Attorney, Agent, or Firm*—Flynn, Thiel, Boutell & Tanis, P.C.

[57] ABSTRACT

A downwardly acting air-outlet nozzle is provided in a device for packaging between a funnel and a fill pipe for the purpose of creating air flow and to thus cause a fill material to drop quicker through the fill pipe. It is possible through the special arrangement of the air-outlet nozzle to utilize common funnels and fill pipes in such a device and to achieve positive fill material acceleration.

13 Claims, 2 Drawing Sheets

DEVICE FOR PACKAGING

FIELD OF THE INVENTION

The invention relates to a device for packaging, in particular on a vertical tubular bagging machine, comprising a vertically aligned fill pipe, a funnel for filling a fill material into the vertically aligned fill pipe, a forming shoulder on the fill pipe for shaping a foil sheet into a foil tube, whereby the foil tube surrounds the fill pipe, an air-outlet nozzle on the funnel and a mechanism connected to the air-outlet nozzle through a supply pipeline for producing an air flow in order to create an air flow in the funnel and in the fill pipe, which air flow enables the fill material to move quicker through the funnel and the fill pipe into the foil tube.

BACKGROUND OF THE INVENTION

Such a device is known from EP-OS 0 192 604. A plurality of flap-shaped air nozzles are in this device provided in the funnel wall or the fill pipe for the purpose of producing a downwardly directed air flow in the fill pipe in order to produce a quicker drop of the fill material than its natural falling speed.

The known device has the disadvantage that its manufacture is relatively complicated. It is necessary to cut each individual flap forming an air nozzle out of the funnel or the fill pipe and to deform same. Thus, the funnel or the fill pipe becomes relatively expensive. In addition, storage of both the common funnels and fill pipes, and also of funnels or fill pipes with integrated air nozzles is necessary, which results in increased storage needs.

The basic purpose of the invention is to design a device of the above-described type so that manufacture is simplified and the increased storage is not needed.

SUMMARY OF THE INVENTION

The purpose is attained by providing a vertically aligned fill pipe, a funnel for filling a fill material into the vertically aligned fill pipe, a forming shoulder on the fill pipe for shaping a foil sheet into a foil tube to be filled, whereby the foil tube surrounds the fill pipe, an air-outlet nozzle on the funnel, and a mechanism connected to the air-outlet nozzle through a supply pipeline for producing an air flow in order to create an air flow in the funnel and in the fill pipe, which air flow enables the fill material to move quicker through the funnel and the fill pipe into the foil tube. Accordingly, a downwardly acting air-outlet nozzle is provided in the passage between the funnel and the fill pipe.

The invention has the advantage that common funnels and fill pipes can be utilized thus eliminating increased storage needs. Furthermore, the manufacture is simplified since construction of air nozzles in the funnel or in the fill pipe is not necessary. An air-outlet nozzle is provided by a gap where the funnel is slightly removed from the fill pipe. The air-outlet nozzle creates a downward air flow and causes a reduced pressure in the funnel so that fill material passes through the funnel quicker. In addition, downwardly directed air flow from the air nozzle accelerates the fill material during its free fall.

When the air-outlet nozzle is a circular gap, to which is connected a circular pressure chamber annularly surrounding the funnel or the fill pipe, then air flow is evenly created, which grips all small particles of the fill material in the same manner, and which thus results in a particularly short packaging time.

The air flow is further improved when, in addition to the air-outlet nozzle, a suction device is provided. When the fill pipe is concentrically surrounded by a format pipe open at its bottom, and when the space between the fill pipe and the format pipe is connected to the suction device, then it is possible for the air inside the fill pipe to flow downwardly in order to shorten the falling time of the fill material, and to escape upwardly through the space. The foil tube is received on the format pipe.

When a control unit for adjusting the excess pressure in the bag to be manufactured is provided on the mechanism, the air flow can be adjusted so that a specific excess pressure, for example for a specific bag size and a specific fill material, is provided. Such a control unit, which controls the air flow also dependent on the performance of the packaging machine, is advantageous in particular for a fill material, for example potato chips, which reacts well to air flow. In addition, a bag firmly filled with air protects the fill material against damage.

A technical simplification of the device exists when the mechanism also acts as a suction device. A flow cycle for the air is then achieved.

In addition, when a further air-outlet nozzle is provided, the air flow is further improved and the falling speed can be further increased, for example through a greater and more exact air flow. The additional air-outlet nozzle can be provided in the funnel, in the fill pipe or on the inside wall of the fill pipe.

When the funnel or the fill pipe is elevationally adjustable in such a manner that one air-outlet nozzle is selectively produced, then packaging can take place with the device selectively with or without support of an air flow. The air-outlet nozzle is then created by a slight moving apart of the funnel and fill pipe and is again eliminated by moving the funnel and fill pipe toward one another. The size and, thus, the performance of the nozzle can be varied when the funnel or the fill pipe is elevationally adjustable in such a manner that the air-outlet nozzle can be adjusted to be narrower or wider. The air flow or rather the falling behavior of the fill material can be influenced in this manner by means of a simple elevation-adjusting mechanism.

BRIEF DESCRIPTION OF THE DRAWINGS

The invention will be discussed in greater detail hereinafter in connection with the single figure, which shows.

DETAILED DESCRIPTION

Figure 1:
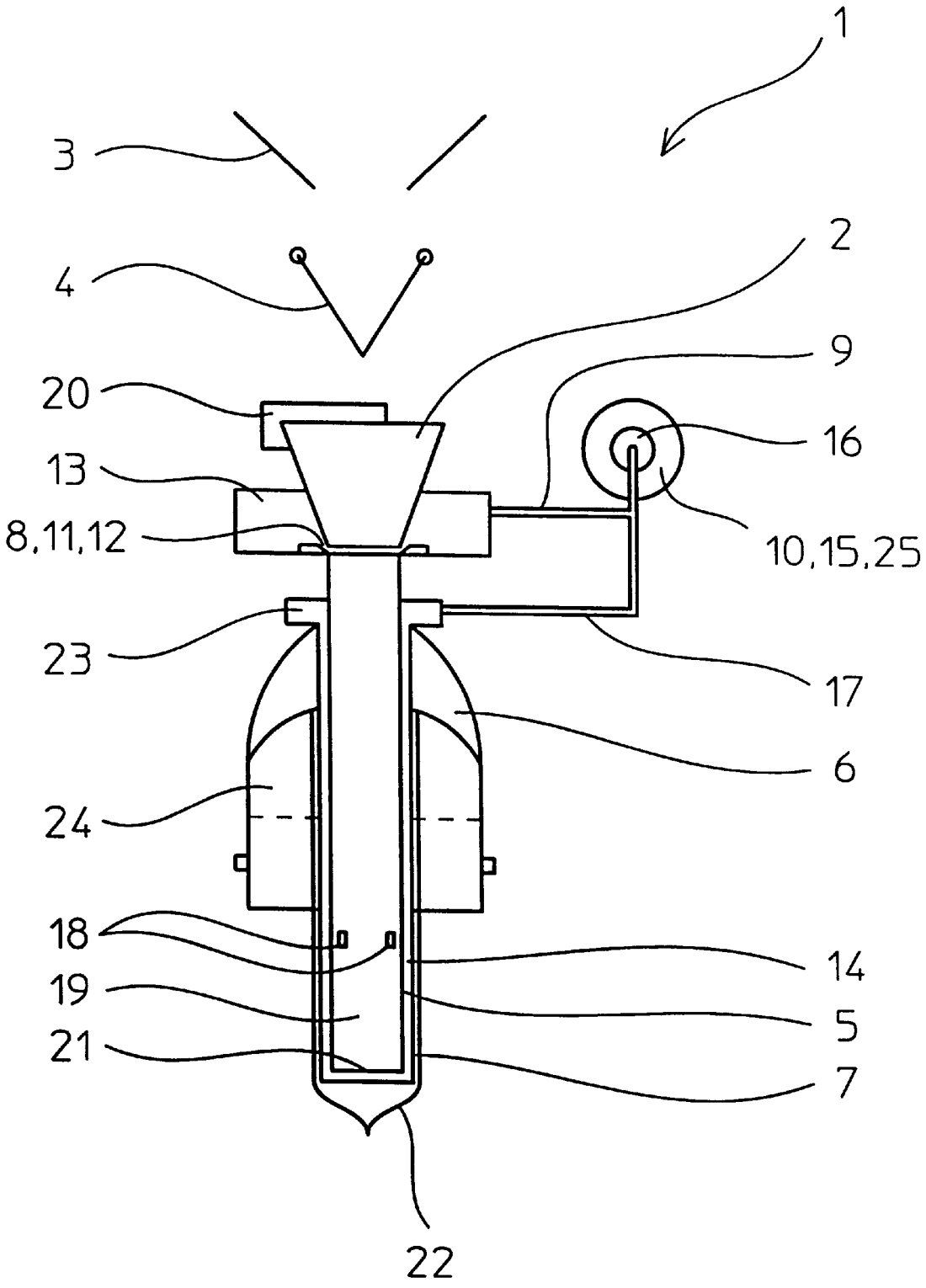
FIG. 1 is a schematic side view of a device for packaging, comprising a funnel for filling of a fill material into a fill pipe, an air-outlet nozzle designed as a circular gap between the funnel and the fill pipe, which is surrounded by a pressure chamber, a mechanism for creating an air flow, which pumps air to the air-outlet nozzle and sucks in air through a space between the fill pipe and a format pipe surrounding the fill pipe, a forming shoulder for shaping a foil sheet into a foil tube, and a dosing device and a timing hopper above, and two additional air-outlet nozzles in the device.

A funnel 2 is used in a packaging device 1 to guide a fill material cast by a dosing device 3 and timing hopper 4 into a fill pipe 5. The fill pipe 5 is vertically aligned and is part of a vertical tubular bagging machine.

The forming shoulder 6 is used to shape a flat foil sheet 24 into a foil tube 22, which is received around a format pipe 7, and into which a filling action is intended to occur.

An air-outlet nozzle 8 is provided on the funnel 2, which is supplied with pressurized air through a supply pipeline 9 from a mechanism 10 for creating an air flow. The air flow is downwardly directed in the fill pipe 5 in order to move the fill material more quickly through the funnel 2 and the fill pipe 5 into the foil tube than occurs in a free fall.

The air-outlet nozzle 8 is provided in an opening 11 between the funnel 2 and fill pipe 5. The air-outlet nozzle 8 is a circular gap 12, to which is connected a circular pressure chamber 13 annularly surrounding the funnel 2. The fill pipe 5 is concentrically surrounded by the format pipe 7, which is open at the bottom. A space 14 between the fill pipe 5 and the format pipe 7 is connected through a pipeline 17 to the mechanism 10, which also serves as the suction device 15 for the air flow existing at the bottom from the fill pipe 5. A specific above atmosphere pressure in the fill pipe 5 and thus in the bag to be created is achieved by means of a control unit 16 on the mechanism 10.

Figure 2:
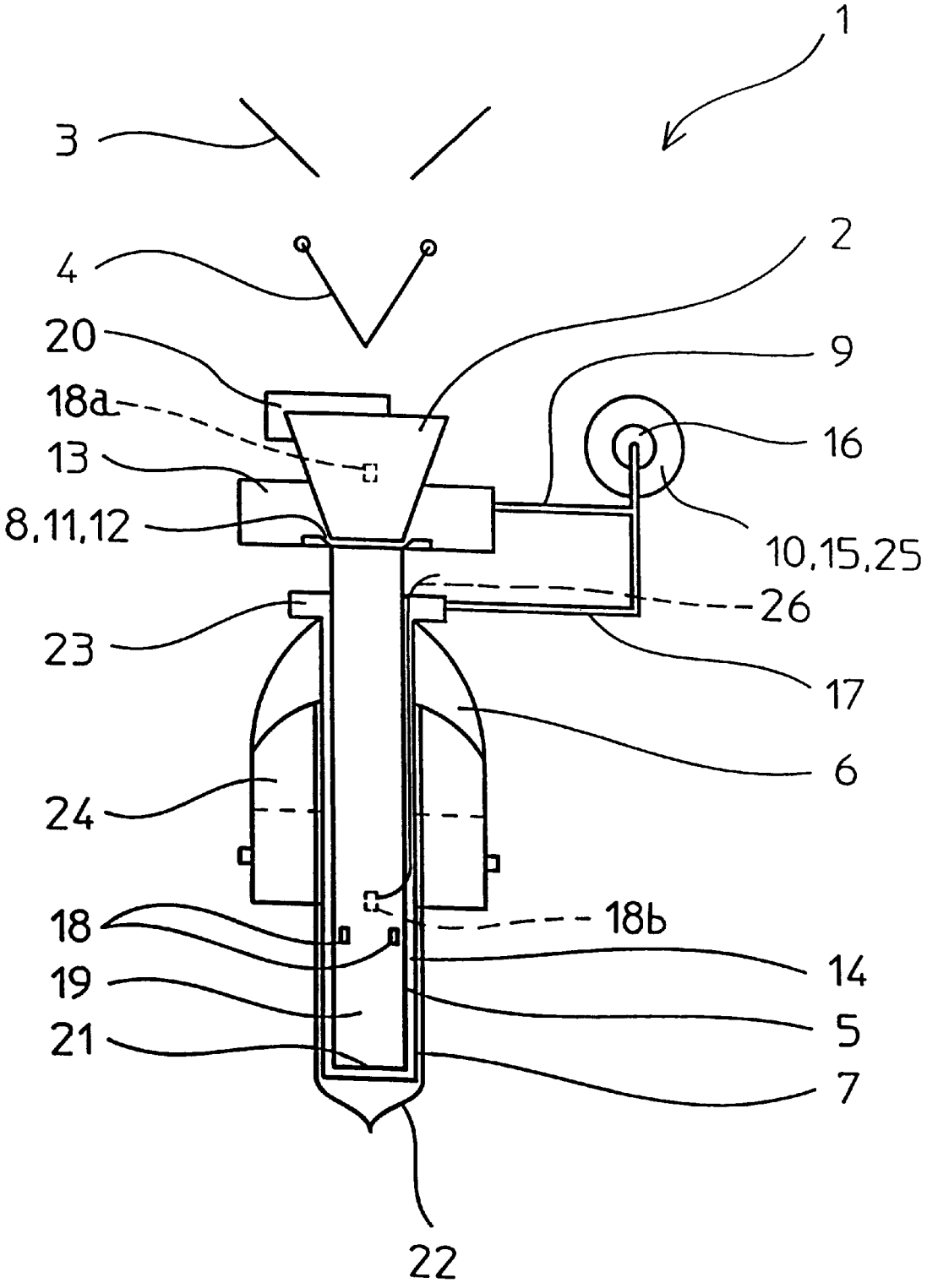
FIG. 2 is a modified view of the FIG. 1 device.

In addition to the air-outlet nozzle 8, two further air-outlet nozzles 18 are provided, which are supplied by a separate pressurized-air producer 26 (FIG. 2), and which are provided on the inside wall 19 of the fill pipe 5. Additional air-outlet nozzles 18*a* and 18*b* (FIG. 2) are respectively provided in the funnel 2 and in fill pipe 5.

The funnel 2 is elevationally adjustable by means of an elevation-adjusting mechanism 20 such that the air-outlet nozzle 8 can be produced and can be adjusted to be narrower or wider.

A fill material portion is initially fed by the dosing device 3 to the timing hopper 4. Same casts the fill material at specific times into the fill pipe 5. The mechanism 10 supplies the pressure chamber 13 continuously with pressurized air so that the air-outlet nozzles 8, 18 maintain continuous air flow downwardly through the fill pipe 5. However, it would also be possible to supply a pulsed air flow with the device of this invention. The air flow escapes out of the lower end 21 of the fill pipe 5. The fill material downwardly accelerated by the air flow is there cast into the foil tube 22 which is welded shut at the bottom. Whereas the air flow moves through the space 14, the cover 23 and the pipeline 17 to the mechanism 10, which is a blower 25.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A device for packaging including a vertically aligned fill pipe, a funnel for feeding a fill material into the fill pipe, a forming shoulder for shaping a sheet into a tube to be filled, whereby the tube surrounds the fill pipe, an air-outlet nozzle defined in a space between the funnel and the fill pipe, and a mechanism connected to the air-outlet nozzle through a supply pipeline for producing an air flow in order to create a downward air flow in the funnel and in the fill pipe, which air flow entrains the fill material to enable quick movement thereof through the funnel and the fill pipe into the tube, a format pipe surrounding said fill pipe, the air flow and entrained fill material moving downwardly throughout the length of said fill pipe, and means for removing the air flow from the tube and the lower end of said fill pipe.

2. The device according to claim 1, wherein the air-outlet nozzle is an annular gap to which is connected an annularly circular pressure chamber surrounding at least one of the funnel and the fill pipe.

3. The device according to claim 1, wherein said means for removing air flow includes a suction device, wherein the fill pipe and the format pipe are open at bottoms thereof, and a space between the fill pipe and the format pipe is connected to said suction device for vacuuming off air.

4. The device according to claim 1, wherein the mechanism includes a control unit for adjusting the excess pressure in a bag to be manufactured from the tube.

5. The device according to claim 3, wherein the mechanism and the suction device are integral.

6. The device according to claim 1, wherein at least one further air-outlet nozzle is provided on the funnel, or on the fill pipe.

7. The device according to claim 1, wherein the funnel or the fill pipe is elevationally adjustable by means of an elevation-adjusting mechanism so that the air-outlet nozzle is selectively adjustable.

8. The device according to claim 7, wherein the funnel or the fill pipe is elevationally adjustable so that the width of the air-outlet nozzle is adjustable.

9. A vertical tubular bagging device for packaging a fill material into bags, comprising:

an elongate, vertical first pipe including an open lower end which allows fill material therein to drop into a bag, a funnel aligned with and vertically spaced from an upper end of said first pipe, said funnel guiding fill material into said first pipe, an air nozzle defined in the space between said upper end of said first pipe and said funnel, an air supply mechanism connected to said air nozzle and supplying an air flow through said air nozzle into said first pipe so as to entrain and accelerate fill material from said funnel to said lower end of said first pipe, an elongate, vertical second pipe radially spaced from and surrounding said first pipe, said second pipe including an open lower end and a forming shoulder receiving a sheet of bag material and forming a sheet into a tube surrounding said second pipe, an air flow passage defined in the space between said first and second pipes, and an air flow exit connected to said air flow passage, whereby said air supply mechanism introduces an air flow through said nozzle, the air flow traveling downwardly through said first pipe to create a suction on the fill material in said funnel, the fill material accelerating from said funnel and being entrained in the air flow through the length of said first pipe into a closed, bag end of the tube, the air flow exiting said lower end of said first pipe and entering said air flow passage, and the air flow exiting said air flow passage through said air exit so that the air flow is drawn from the bag while the fill material is accelerated into the bag.

10. The device according to claim 9, wherein said air exit opens into said air flow passage through said second pipe spaced upwardly from said lower end of said second pipe and said forming shoulder.

11. The device according to claim 9, wherein said second pipe is coaxial to said first pipe.

12. The device according to claim 11, wherein said air flow passage is elongate and extends the length of said second pipe, and said air exit communicates with said air flow passage above said passage.

13. A device for packaging including a vertically aligned fill pipe, a funnel for feeding a fill material into the fill pipe, a forming shoulder for shaping a sheet into a tube to be filled, whereby the tube surrounds the fill pipe, an air-outlet nozzle fluidly communicating with said fill pipe, and a mechanism connected to the air-outlet nozzle through a supply pipeline for producing an air flow in order to create a downward air flow in the funnel and in the fill pipe, which air flow entrains the fill material to enable quick movement thereof through the funnel and the fill pipe into the tube, a format pipe surrounding said fill pipe, the air flow and entrained fill material moping downwardly throughout the length of said fill pipe, and means for removing the air flow from the tube and the lower end of said fill pipe, wherein at least one further air-outlet nozzle is positioned in one of the funnel and the inner pipe.

* * * * *